US008868415B1

(12) United States Patent
Rai et al.

(10) Patent No.: US 8,868,415 B1
(45) Date of Patent: Oct. 21, 2014

(54) DISCONTINUOUS TRANSMISSION CONTROL BASED ON VOCODER AND VOICE ACTIVITY

(75) Inventors: Deveshkumar Rai, Overland Park, KS (US); Sachin R. Vargantwar, Macon, GA (US); Maulik K. Shah, Overland Park, KS (US); Jasinder P. Singh, Olathe, KS (US)

(73) Assignee: Sprint Spectrum L.P., Overland Park, KS (US)

( * ) Notice: Subject to any disclaimer, the term of this patent is extended or adjusted under 35 U.S.C. 154(b) by 219 days.

(21) Appl. No.: 13/477,231

(22) Filed: May 22, 2012

(51) Int. Cl.
*G10L 21/00* (2013.01)

(52) U.S. Cl.
USPC ..... 704/226; 704/227; 704/228; 455/426.1

(58) Field of Classification Search
USPC ..... 455/426.1; 704/226
See application file for complete search history.

(56) References Cited

U.S. PATENT DOCUMENTS

| | | | | |
|---|---|---|---|---|
| 8,543,388 | B2 * | 9/2013 | Sandgren et al. | 704/219 |
| 2006/0293885 | A1 * | 12/2006 | Gournay et al. | 704/223 |
| 2008/0080568 | A1 * | 4/2008 | Hughes et al. | 370/519 |
| 2010/0191522 | A1 * | 7/2010 | Zhang et al. | 704/201 |
| 2011/0004471 | A1 * | 1/2011 | Schandl et al. | 704/226 |
| 2011/0194538 | A1 * | 8/2011 | Zheng et al. | 370/335 |
| 2013/0007484 | A1 * | 1/2013 | Gobriel et al. | 713/320 |

* cited by examiner

*Primary Examiner* — Mazda Sabouri

(57) ABSTRACT

A method and system is disclosed for control of discontinuous transmission based on vocoder and voice activity. An access terminal (AT) may engage in a communication session via an encoder-decoder in a network device in a wireless network. During silence intervals of the communication session, when the AT has no data to transmit, the AT may transmit periodic silence frames at a silence-frame rate to the encoder-decoder. The silence frames may contain parameters for generation of audio noise by the network device. Upon determining that the encoder-decoder has ceased transmitting data to the AT in response to a prolonged absence of transmissions from the AT, the AT may increase the silence-frame rate so as to reduce the duration of the absence of transmissions from the AT, and correspondingly cause the encoder-decoder to begin transmitting audio data to the AT.

24 Claims, 6 Drawing Sheets

DISCONTINUOUS TRANSMISSION CONTROL BASED ON VOCODER AND VOICE ACTIVITY

BACKGROUND

In a typical cellular radio communication system (wireless communication system), an area is divided geographically into a number of cell sites, each defined by a radio frequency (RF) radiation pattern from a respective base transceiver station (BTS) antenna. The base station antennas in the cells are in turn coupled to a base station controller (BSC), which is then coupled to a telecommunications switch or gateway, such as a mobile switching center (MSC) and/or a packet data serving node (PDSN) for instance. The switch or gateway may then be coupled with a transport network, such as the PSTN or a packet-switched network (e.g., the Internet).

When an access terminal (such as a cellular telephone, pager, or appropriately equipped portable computer, for instance) is positioned in a cell, the access terminal (also referred to herein by "AT") communicates via an RF air interface with the BTS antenna of the cell. Consequently, a communication path is established between the AT and the transport network, via the air interface, the BTS, the BSC and the switch or gateway. Functioning collectively to provide wireless (i.e., RF) access to services and transport in the wireless communication system, the BTS, BSC, MSC, and PDSN, comprise (possibly with additional components) what is typically referred as a Radio Access Network (RAN).

As the demand for wireless communications has grown, the volume of call traffic in most cell sites has correspondingly increased. To help manage the call traffic, most cells in a wireless network are usually further divided geographically into a number of sectors, each defined respectively by radiation patterns from directional antenna components of the respective BTS, or by respective BTS antennas. These sectors can be referred to as "physical sectors," since they are physical areas of a cell site. Therefore, at any given instant, an access terminal in a wireless network will typically be positioned in a given physical sector and will be able to communicate with the transport network via the BTS serving that physical sector.

As an access terminal moves between wireless coverage areas of a wireless communication system, such as between cells or sectors, or when network conditions change or for other reasons, the AT may "hand off" from operating in one coverage area to operating in another coverage area. In a usual case, this handoff process is triggered by the access terminal monitoring the signal strength of various nearby available coverage areas, and the access terminal or the BSC (or other controlling network entity) determining when one or more threshold criteria are met. For instance, the AT may continuously monitor signal strength from various available sectors and notify the BSC when a given sector has a signal strength that is sufficiently higher than the sector in which the AT is currently operating. The BSC may then direct the AT to hand off to that other sector.

In some wireless communication systems or markets, a wireless service provider may implement more than one type of air interface protocol. For example, a carrier may support one or another version of CDMA, such as EIA/TIA/IS-2000 Rel. 0, A, and CDMA 2000 Spread Spectrum Systems Revision E (collectively referred to generally herein as "IS-2000") for both circuit-cellular voice and data traffic, as well as a more exclusively packet-data-oriented protocol such as EIA/TIA/IS-856 Rel. 0, A, or other version thereof (hereafter "IS-856"). Under IS-2000, packet-data communications may be referred to as "1X-RTT" communications, also abbreviated as just "1X." However, since IS-2000 supports both circuit voice and packet data communications, the term 1X (or 1X-RTT) is sometimes used to more generally refer the IS-2000 air interface, without regard to the particular type of communication carried. Packet-data communications under IS-856 are conventionally referred to as "EVDO" communications, also abbreviated as just "DO." Access terminals may be capable of communication with either or both protocols, and may further be capable of handing off between them, in addition to being able to hand off between various configurations of coverage areas.

OVERVIEW

Under IS-2000 (and other versions of CDMA) and IS-856, communications from the wireless communication system (or the "wireless network") to an access terminal are carried on a "forward link" of the air interface, and communications from an access terminal to a base station are carried on a "reverse link" of the air interface. For IS-2000, data sent on both the forward and reverse links are assembled into units called frames, which contain data encoded for transmission to or from the access terminal (and correspondingly, from or to the base station), and are transmitted at regular intervals (corresponding to a frame rate), typically 20 milliseconds in duration (although other transmission intervals can be used). The receiving entity (e.g., access terminal on the forward link, and the wireless network—or a network device therein—on the reverse link) decodes the encoded data in received frames to recover the original data.

Encoding typically involves compression of data from an input bit rate to an output bit rate, where the output bit rate usually requires reduced transmission bandwidth (or data storage space) compared with the input bit rate. The amount of compression achieved depends on the compression scheme or algorithm applied, including whether or not any information in the input data is lost or modified in the process (e.g., rendered in some form of analytic approximation in order to accommodate reduced "volume"). The decoding process essentially reverses the encoding process, including decompressing the compressed data. The fidelity of the recovered data to the original data depends, in part, on how well the compression-decompression scheme compensates for lost or modified information, as well as the ability of the scheme to correct for degradation due to imperfect transmission (e.g., errors, noise, etc.).

The implementation of an encoding-decoding algorithm is referred to as a "codec" (for coder/decoder), and usually takes the form of a device (e.g., a digital signal processor, or the like) and/or computer-executable instructions (e.g., software, firmware, etc.). Different codecs may implement different encoding-decoding schemes, including the ability to achieve different levels of compression and/or different degrees of protection against transmission errors, and a given codec may have different modes of operation that similarly accommodate different levels of compression and/or different degrees of protection against transmission errors. Codecs typically comply with one or another industry standard in order to help insure interoperability.

In a deployment of a communication system, such as a wireless network, a variety of types of codecs may be used, although not all devices that operate or are configured to operate in the system or network will necessarily employ all of the variety of types. However, any pair of devices usually must share at least one common type of codec, or at least a common set of codec functions, in order to transmit/receive encoded/compressed data on a commonly-terminated communication link. For example, an access terminal and an MSC may terminate a common link of a voice call using a common audio codec or a common set of audio codec functions for voice communications.

More particularly to the example of voice communications, digitally sample voice data may be encoded by a type of audio codec called a "vocoder" (for voice encoder/decoder). Thus, for a voice call in a wireless communication system, a vocoder may be used to terminate each end of a common link between an access terminal and an MSC. The vocoder used by the access terminal may be the same as that used by the MSC, or at least have common capabilities that support the common link of the voice call. Vocoders generally provide optimized encoding for voice communications, thereby helping conserve bandwidth consumption on the air link between an access terminal and the wireless network (e.g., the between the AT and a BTS in the network). In addition, some vocoders may be able to distinguish voice input from non-voice input (e.g., silence, noise, etc.), which can then be used to recognize time intervals during which there may be no voice or audio data to transmit, and bandwidth can therefore be further conserved.

In particular, a wireless communication system (or network) may employ discontinuous transmission, or "DTX," in which detection of voice activity—or lack thereof—at a source device is used to control when and whether the source device actually transmits and when and whether it refrains from transmitting. For example, DTX may be used in networks that operate under CDMA 2000 Spread Spectrum Systems Revision E (also referred to as "1X Advanced"). Because intervals of voice (or audio) silence in a continuous-transmission voice (or more generally an audio) call are typically perceived by a listener as audio "noise," some form of substitute or artificial noise may be introduced during silence intervals of a DTX-based voice (or audio) call in order to replace what might otherwise be perceived by the listener as pure silence. This allows bandwidth to be conserved when there is no voice (or audio) data to transmit, but still provides the listener with so-called "comfort noise" instead of pure silence, which can sometimes convey uncertainty about call status as discerned from audio characteristics.

More specifically, during times when voice input is determined to be active, the source device, such as an AT, may transmit continuous frames of voice data encoded at a maximum or "full" output bit rate. However, rather than transmit continuous frames of audio noise during times when voice activity is determined to be inactive, the source device may instead transmit only periodic frames containing a parameterized description of audio noise. The receiving device may then synthetically generate comfort noise based on the parameters.

The parameterized description of the audio noise is assembled in a data structure sometimes referred to as a "silence insertion descriptor" (or "SID"), and the frames that carry SIDs are called "silence frames" or, sometimes, SID frames. The data carried in a SID are typically of smaller volume that voice or audio data. Consequently, a SID can be encoded at a lower bit rate than is usually afforded voice data. For example, in DTX under 1X Advanced, SIDs are encoded at one-eighth the full rate. Thus, in addition to conserving bandwidth by transmitting SID frames only periodically, the lower bit rate further reduces bandwidth consumption.

Some vocoders that receive periodic SID frames below a threshold rate may enter a "mute" state in which they cease transmissions to the sender of the SID frames. For instance, a vocoder in an MSC (or other network switch) may enter a mute state if the time between SID frames from an access terminal exceeds a threshold duration. A mute state that persists for longer than a certain amount of time during a voice call in a wireless network can result in the call being dropped. As a partial remedy, an access terminal may be configured to transmit SID frames above the threshold rate, and thereby avoid causing the vocoder in the MSC to transition to mute-state operation. However, the threshold rate may differ from one vocoder to another, particularly for vocoders in MSCs that may represent a wide variety of manufactures, models, and deployment histories. Accordingly, it would be desirable for an access terminal that is transmitting silence frames to be able to determine that the receiving vocoder has, or is likely to, enter a mute state. The AT may then dynamically increase its rate of silence frame transmissions so as to prevent or discourage the receiving vocoder from entering the mute state, or to cause the receiving vocoder to exit the mute state.

Hence in one respect, various embodiments of the present invention provide, in an access terminal (AT) configured to engage in communication sessions via a wireless communication network, a method comprising: during silence intervals of a communication session in which the AT has determined it has no audio data to transmit, ceasing transmissions to the wireless communication network, except for transmitting silence frames at a silence-frame rate to an encoder-decoder in a network device in the wireless communication network, the silence frames containing parameters for generation of audio noise by the network device; making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT.

In another respect, various embodiments of the present invention provide, in an access terminal (AT) configured to engage in communication sessions via a wireless communication network, the AT comprising: one or more processors; memory accessible by the one or more processors; and computer-readable instructions stored in the memory that upon execution by the one or more processors cause the AT to carry out functions including: during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device, making a determination that in response to an absence of transmissions from the AT for a duration at least as long as a threshold time interval, the encoder-decoder has ceased transmitting audio data to the AT, and in response to making the determination, increasing the silence-frame rate so as to reduce the duration of the absence of transmissions from the AT to be shorter than the threshold time interval, and correspondingly cause the encoder-decoder to begin transmitting audio data to the AT.

In yet another respect, various embodiments of the present invention provide, in a non-transient computer-readable medium having instructions stored thereon that, upon execution by one or more processors of an access terminal (AT) configured to engage in communication sessions via a wireless communication network, cause the AT to carry out functions including: during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device; making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT.

These as well as other aspects, advantages, and alternatives will become apparent to those of ordinary skill in the art by reading the following detailed description, with reference where appropriate to the accompanying drawings. Further, it should be understood that this summary and other descriptions and figures provided herein are intended to illustrate the invention by way of example only and, as such, that numerous variations are possible. For instance, structural elements and process steps can be rearranged, combined, distributed, eliminated, or otherwise changed, while remaining within the scope of the invention as claimed.

DETAILED DESCRIPTION

Example embodiments will be described by way of example with reference to Code Division Multiple Access ("CDMA") communications in general, and to IS-856 and IS-2000 communications in particular. As described below, IS-2000 applies to both circuit-cellular and packet-data communications, and is referred to herein as "conventional" CDMA communications. IS-856 applies more exclusively to packet-data communications (including, e.g., real-time voice and data applications), and is referred to herein as "high rate" packet-data communications. It should be understood that example embodiments can apply to other wireless voice and data protocols including, without limitation, IS-95 and GSM, which, together with IS-856 and IS-2000 are considered herein, individually or in combination, to comprise a CDMA family of protocols.

Figure 1:
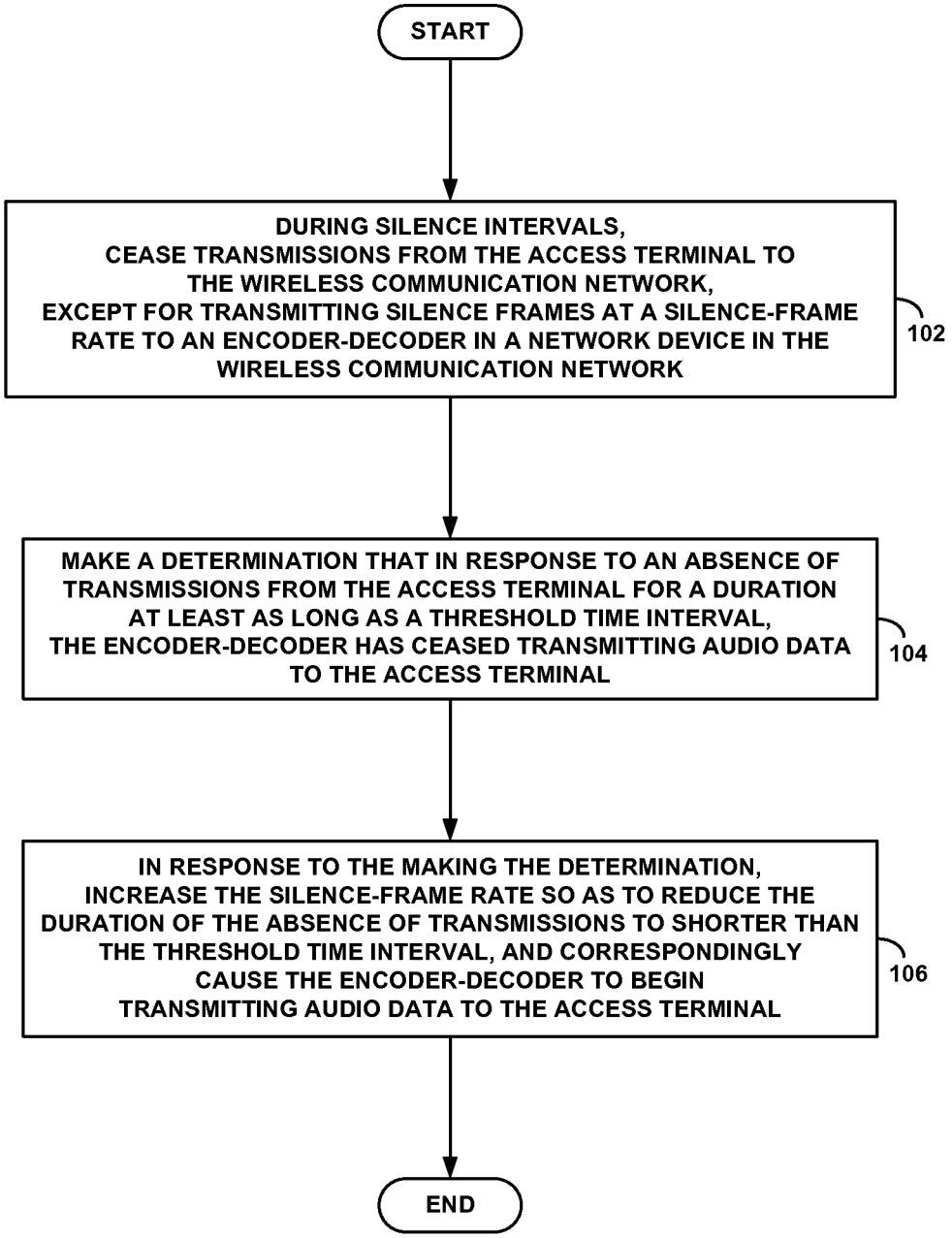
FIG. 1 is a flowchart illustrating an example embodiment of control of discontinuous transmission based on vocoder and voice activity.

FIG. 1 is a flowchart illustrating an example method of control of discontinuous transmission based on vocoder and voice activity. By way of example, the method could be carried out by an access terminal configured to operate according to a CDMA family of protocols, including at least CDMA 2000 Spread Spectrum Systems Revision E. Further, the access terminal may be considered operating in a wireless communication system (or wireless communication network) that is also configured to operate according to a CDMA family of protocols.

At step 102, the AT is engaging in a communication session via the wireless communication network. During silence intervals of the communication session, the AT ceases transmissions to the wireless communication network, except for transmitting silence frames at a silence-frame rate to an encoder-decoder in a network device in the wireless communication network. Silence intervals are times during which the AT has no audio data to transmit, and the AT may recognize or determine a silence interval by determining the absence of audio data. Silence frames are those containing parameters for generation of audio noise by the network device.

At step 104, the AT makes a determination that the encoder-decoder has ceased transmitting audio data to the AT in response to an absence of transmissions from the AT. Since the time between silence frames may be counted as an absence of transmissions from the AT, and the AT can determine the duration of this inter-frame interval, the AT can therefore determine when the absence of its transmissions has lasted for at least as long a threshold time interval. Based on this determination, the AT can then determine or infer, for example, that a cessation of audio transmissions from the encoder-decoder is responsive to an absence of transmission from the AT.

At step 106, the AT responds to making the determination by increasing the silence-frame rate. By doing so, the AT reduces the duration of the absence of transmissions to less than the threshold time interval. Correspondingly, the reduced duration may cause the encoder-decoder to begin transmitting audio data to the AT.

In accordance with the example embodiment, the communication session may be an voice (or audio) communication session carried out via the network device. In this case the encoder-decoder could be a vocoder. A voice (or audio) communication may typically be transmitted in continuous frames; e.g., an uninterrupted sequence of frames, each carrying encoded voice (or audio) data. In ceasing transmissions to the wireless communication network, except for transmitting silence frames, the AT could interrupt continuous transmission of sequential frames of audio data, and then during the interruption, the AT could transmit the silence frames interspersed with inter-frame intervals of no transmission. Each the inter-frame interval could correspond to the arithmetic inverse of the silence-frame rate.

More specifically, under CDMA 2000 Spread Spectrum Systems Revision E, the communication session could be a voice call that includes a segment (or "leg") terminated at one end by the AT and at the other end by a vocoder in an MSC (or other network switch). The call could be carried out using a discontinuous transmission (DTX) scheme. During each silence interval the AT could transmit periodic silence frames. Each silence frame could carry a silence insertion descriptor (SID) that includes a parameterized characterization of audio noise. The vocoder could then use SIDs to generate comfort noise. Voice (or audio) frames—i.e., those carrying voice (or audio) data—could be encoded at a full bit rate (or a bit rate commensurate with a given quality level, for example), while SID frames (i.e., silence frames) could be encoded at one-eighth the full encoding rate (or a bit rate commensurate with transmission of parameter and/or control data, for example).

In a DTX scheme, the inter-frame interval could be configured according to system parameters called "DTX maximum" (or "DTXmax") and "DTX minimum" (or "DTXmin"). More particularly, DTXmax and DTXmin define a range for the inter-frame interval, where DTXmax≥DTXmin. With this arrangement, the AT transmits at least one SID frame within DTXmax of a previous SID frame. Accordingly, the rate of SID frame transmissions (i.e., the silence-frame rate) tends to increase as DTXmax decreases, and vice versa.

In further accordance with the example embodiment, the AT could make the determination (at step 104) that the encoder-decoder has ceased transmitting audio data to the AT in response to an absence of transmissions from the AT by monitoring audio transmissions from the network device. More specifically, the AT could determine that it is operating during a silence interval, and will therefore transmit only periodic silence frames, so that the network device will necessarily detect an absence of transmissions from the AT corresponding to inter-frame intervals. By monitoring audio transmissions from the network device and thereby determining that the rate at which audio transmissions are being received by the AT has fallen below a threshold rate, the AT may then infer that the encoder-decoder has responded to the inter-frame intervals by ceasing transmission to the AT.

More particularly for a voice call, a vocoder that terminates a voice-call segment with an AT may enter a mute state after an absence of voice frames from the AT that lasts longer than a threshold amount of time. For instance, a vocoder may expect a continuous sequence of voice frames during a voice call, and consequently interpret an absence of incoming frames during a silence interval of a DTX-based voice call as one or more "blank" frames. On the other hand, the vocoder may recognize a voice frame or an SID frame as a valid frame transmission. Thus, the inter-frame interval between SID frames may be considered an interval of blank frames lasting up to DTXmax. By way of example, a "legacy" vocoder—e.g., one that may have been manufactured and/or deployed prior to the introduction of one or another protocol that supports DTX, such as 1X Advanced—might enter a mute state after an interval of two consecutive blank frames. Accordingly, if the inter-frame interval between SID frames is longer than two blank frames, a legacy vocoder might enter a mute state. In this example, the threshold amount of time would be two frames.

The threshold amount of time beyond which an absence of transmissions from an AT can cause a vocoder to enter a mute state may vary from one vocoder to another. For example, some vocoders may enter a mute state after receiving two blank frames. For other vocoders, the limit could be three, four, or five blank frames. Other limits could be configured as well. Moreover, the limit need not necessarily be an integral number of frames. Further still, different frame durations could be used (e.g., 10 ms, 20 ms, etc.). Hence, in conventional operation, an AT may not be able to distinguish between a mute state of the vocoder due to excessive inter-frame intervals of SID frames from the AT, and a mute state due to some other factor, such as sub-optimal RF conditions on the air interface, for example. However, by recognizing that it is detecting an apparent mute state (e.g., an apparent cessation of transmissions from the vocoder) of the vocoder during a silence interval of a voice call, an AT can thereby determine that the apparent mute state is likely an accurate determination of a mute state, and that it is caused by excessive inter-frame intervals of SID frames from the AT.

More particularly, in a mute state, the vocoder ceases transmitting to the AT. By determining that the rate of received transmissions from the vocoder is below a threshold rate, the AT may therefore determine or infer that the vocoder has entered a mute state. Moreover, if the AT makes the determination of the below-threshold reception rate during a silence interval of a voice call, the AT may determine or infer that the vocoder has entered a mute state in response to an excessive inter-frame interval of SID frames from the AT.

In further accordance with the example embodiment, the AT may monitor the rate of transmissions received from the vocoder by measuring an incoming "voice activity factor" (or "VAF"). More particularly, VAF can be measured as number of frames per unit time (typically, per second) received. Thus, an AT engaging in a voice call via a vocoder could determine if and when the incoming VAF (i.e., incoming from the vocoder) is below a threshold VAF. If this occurs during a silence interval of the voice call, the AT may determine or infer that the vocoder has entered a mute state.

As described above, the AT may respond to determining that the vocoder has ceased transmitting audio data to the AT by increasing its rate of transmission of silence frames to the vocoder (step 106). In doing so, the AT may decrease the inter-frame interval, and thereby cause the vocoder to begin transmitting to the AT again. When a mute state during a voice call persists beyond a one or another time limit, the call may be dropped. Accordingly, when the AT's determination of ceased transmissions from the vocoder corresponds to the vocoder having entered a mute state, taking action that causes the vocoder to begin transmitting to the AT again can cause the vocoder to exit the mute state, and thereby reduce or eliminate the chance of the call being dropped due to persistence of the mute state.

In accordance with the example embodiment, the AT may increase the silence-frame rate by an amount that results in an immediate transmission of a silence frame to the network device (and hence to the vocoder). More specifically, the silence-frame rate may be variable within a range between a minimum rate and a maximum rate, where the minimum rate is configured to be less than or equal to the maximum rate. The AT may then increase the silence-frame rate by adjusting one or both of the minimum and maximum rates, while keeping the minimum rate less than or equal to the maximum rate. In particular, if the minimum rate is currently less than the maximum rate, the AT could increase the minimum rate to a value up and including the maximum rate. This will "squeeze" the silence-frame rate upward. If instead the minimum rate currently equals the maximum rate, the AT can increase both the minimum rate and the maximum rate, again while keeping the minimum rate no greater than the maximum rate. This will move the entire range of silence-frame rate values upward (increasing), taking the silence-frame rate upward as well. By adjusting the minimum and/or maximum rates sufficiently to cause an immediate transmission of a SID frame, the AT may thus cause the vocoder to exit a mute state.

Again considering the example of a DTX-based call in accordance with CDMA 2000 Spread Spectrum Systems Revision E, increasing the silence-frame rate could be accomplished by adjusting one or both of DTXmin and DTXmax. More specifically, if DTXmax is currently greater than DTXmin, the AT could decrease DTXmax to down to an inclusive limit of DTXmin. This would "squeeze" the inter-frame interval to smaller values, and hence cause a SID frame transmission sooner than other would have occurred. If instead DTXmax currently equals DTXmin, the AT could decrease both DTXmax and DTXmin, again while keeping DTXmax no smaller than DTXmin. This would move the entire range of inter-frame intervals downward (decreasing), taking the inter-frame interval downward as well. For a sufficient downward shift of the range, the AT could cause an immediate transmission of a SID frame, and again force or "encourage" the vocoder to exit the mute state.

In further accordance with the example embodiment, the network device and/or the encoder-decoder therein could inform the AT when the encoder-decoder has ceased transmitting audio data to the AT as a result of prolonged absence of transmissions from the AT. More specifically, upon ceasing transmissions to the AT due to an absence of transmissions from the AT, the encoder-decoder could issue a message as such to the AT. A the same time, the AT could determine that it is operating during a silence interval, and will therefore transmit only periodic silence frames, so that the network device will necessarily detect an absence of transmissions from the AT corresponding to inter-frame intervals. Accordingly, the AT could receive the message from the network device during the silence interval.

Again considering the example of a DTX-based call in accordance with CDMA 2000 Spread Spectrum Systems Revision E, the AT could terminate a call leg with a vocoder in an MSC. During the call, the AT could determine that it is operating during a silence interval, and will therefore transmit only periodic SID frames. As described above, the vocoder could enter a mute state because the inter-frame interval is too long. For example, the vocoder might be configured to enter a mute state after receiving two consecutive blank frames from the AT. The vocoder could then issue a message to the AT that it has entered a mute state in response to the two blank frames (or some other threshold of blank frames). The AT could then adjust the inter-frame interval as described above, thereby causing the vocoder to resume transmissions to the AT.

It will be appreciated that the steps of FIG. 1 are presented by way of example, and that additional and/or alternative steps or alternative ordering of steps could be carried out and still remain within the scope and spirit of the embodiments herein.

Figure 2:
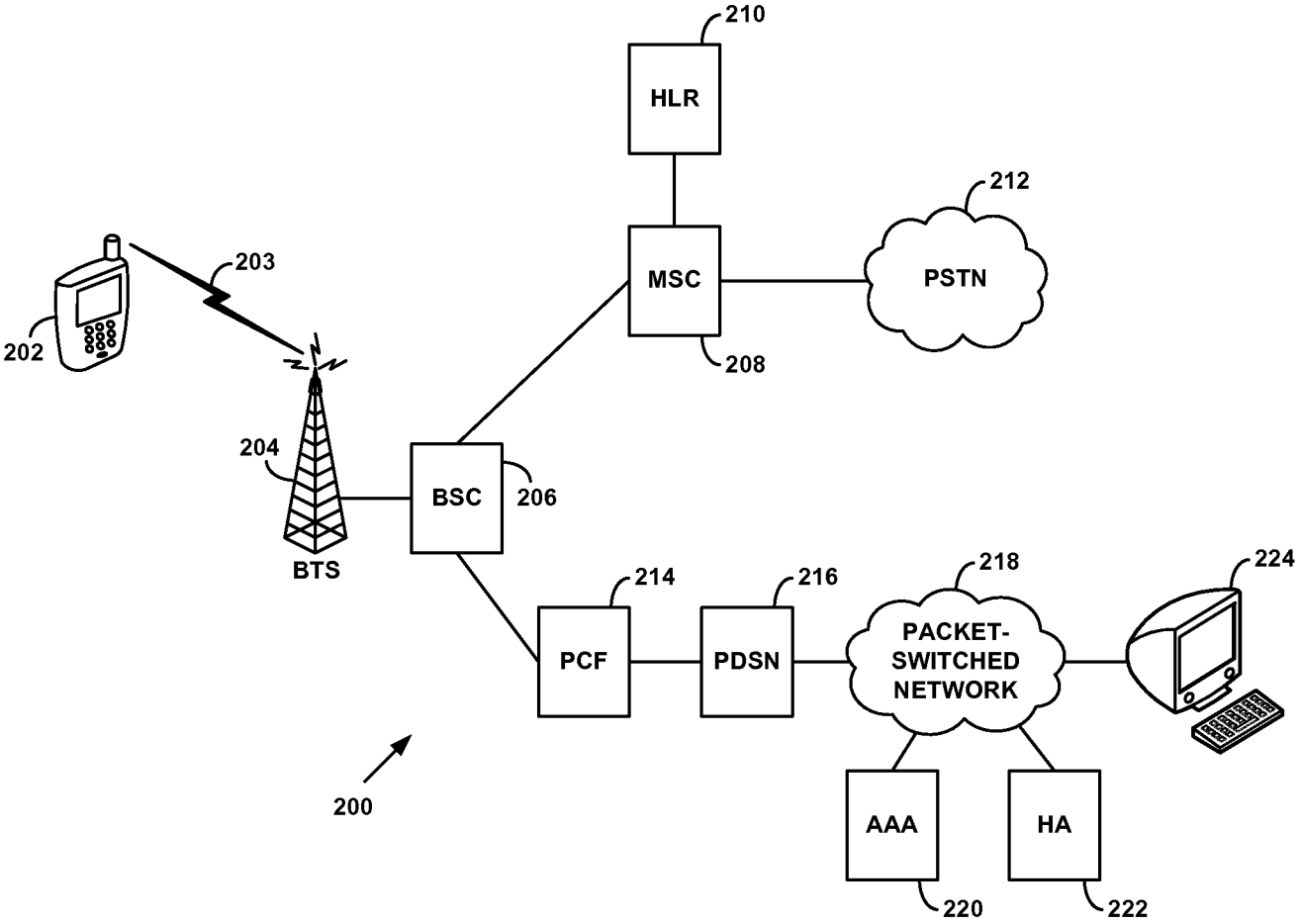
FIG. 2 is a simplified block diagram of a wireless communication system in which example embodiments of control of discontinuous transmission based on vocoder and voice activity can be employed.

FIG. 2 shows a simplified block diagram of a wireless communication system 200 in which an example embodiment of control of discontinuous transmission based on vocoder and voice activity could be employed. Access terminal AT 202 communicates over an air interface 203 with a BTS 204, which is then coupled or integrated with a BSC 206. Transmissions over air interface 203 from BTS 204 to AT 202 represent the forward link to the access terminal (also referred to herein alternatively as the forward link from the base station, and as "the AT's forward link"). Transmissions over interface 203 from AT 202 to BTS 204 represent the "reverse link" (also referred to herein as "the AT's reverse link") It will be appreciated that the arrangement shown in the figure is illustrative.

BSC 206 is connected to MSC 208, which acts to control assignment of air traffic channels (e.g., over air interface 203), and provides access to wireless circuit-switched services such as circuit-voice and circuit-data (e.g., modem-based packet data) service. As discussed above, the MSC 208 may include one or more vocoders (not shown). As represented by its connection to PSTN 212, MSC 208 is also coupled with one or more other MSCs or other telephony circuit switches in the operator's (or in a different operator's) network, thereby supporting user mobility across MSC regions, and local and long-distance landline telephone services. Also connected to MSC 208 is home location register (HLR) 210, which supports mobility-related aspects of subscriber services, including dynamic tracking of subscriber registration location and verification of service privileges.

As shown, BSC 206 is also connected with a PDSN 216 by way of packet control function (PCF) 214. PDSN 216 in turn provides connectivity with a packet-switched network 218, such as the Internet and/or a wireless carrier's private core packet-network. Sitting as nodes on network 218 are, by way of example, an authentication, authorization, and accounting (AAA) server 220, a mobile-IP home agent (HA) 222, and a remote computer 224. After acquiring an air traffic channel over its air interface, an access terminal (e.g., AT 202) may send a request to PDSN 216 for a connection in the packet data network. Then, following authentication of the access terminal by AAA server 220, the access terminal may be assigned an IP address by the PDSN or by HA 222, and may thereafter engage in packet-data communications with entities such as remote computer 224.

It should be understood that the depiction of just one of each network element in FIG. 2 is illustrative, and there could be more than one of any of them, as well as other types of elements not shown. The particular arrangement shown in FIG. 2 should not be viewed as limiting with respect to the present invention or embodiments thereof. Further, the network components that make up a wireless communication system such as system 200 are typically implemented as a combination of one or more integrated and/or distributed platforms, each comprising one or more computer processors, one or more forms of computer-readable storage (e.g., disks drives, random access memory, etc.), one or more communication interfaces for interconnection between elements and the network and operable to transmit and receive the communications and messages described herein, and one or more computer software programs and related data (e.g., machine-language instructions and program and user data) stored in the one or more forms of computer-readable storage and executable by the one or more computer processors to carry out the functions, steps, and procedures of the various embodiments of the present invention described herein. Similarly, a communication device such as exemplary access terminal 202 typically comprises a user-interface, I/O components, a transceiver, a communication interface, a tone detector, a processing unit, and data storage, all of which may be coupled together by a system bus or other mechanism. As such, system 200, AT 202, and air interface 203 are representative of exemplary means of implementing and carrying out the various functions, steps, and procedures described herein.

Throughout this description, the term "base station" will be used to refer to a Radio Access Network (RAN) element such as a BTS, a BSC, or combination BTS/BSC, for instance. The term "radio network controller" (RNC) can also be used to refer to a BSC, or more generally to a base station. In some arrangements, two or more RNCs may be grouped together, wherein one of them carries out certain control functions of the group, such as coordinating handoffs across BTSs of the respective RNCs in the group. The term controlling RNC (or C-RNC) customarily applies to the RNC that carries out these (and possibly other) control functions.

1. CONVENTIONAL CDMA COMMUNICATIONS

In a conventional CDMA wireless network compliant with the well known IS-2000 standard, each cell employs one or more carrier frequencies, typically 1.25 MHz in bandwidth each, and each wireless service sector is distinguished from adjacent sectors by a pseudo-random number offset ("PN offset"). Further, each sector can concurrently communicate on multiple different channels, distinguished from each other by "Walsh codes." When an access terminal operates in a given sector, communications between the access terminal and the BTS of the sector are carried on a given frequency and are encoded by the sector's PN offset and a given Walsh code.

Air interface communications are divided into forward link communications, which are those passing from the base station to the access terminal, and reverse link communications, which are those passing from the access terminal to the base station. In an IS-2000 system, data are transmitted in units of frames on both the forward link and reverse link. On either link, communications in a given wireless service sector are encoded with the sector's PN offset and a given Walsh code. On the forward link, certain Walsh codes are reserved for use to define control channels, including a pilot channel, a sync channel, and one or more paging channels, and the remainder can be assigned dynamically for use as traffic channels, i.e., to carry user communications. Similarly, on the reverse link, one or more Walsh codes may be reserved for use to define access channels, and the remainder can be assigned dynamically for use as traffic channels.

In order to facilitate efficient and reliable handoff of access terminals between sectors, under IS-2000 an AT can communicate on a given carrier frequency with a number of "active" sectors concurrently, which collectively make up the AT's "active set." Depending on the system, the number of active sectors can be up to six (currently). The access terminal receives largely the same signal from each of its active sectors and, on a frame-by-frame basis, selects the best signal to use. An AT's active set is maintained in the access terminal's memory, each active sector being identified according to its PN offset. The AT continually monitors the pilot signals from its active sectors as well as from other sectors, which may vary in as the AT moves about within the wireless communication system, or as other factors cause the AT's RF conditions to change. The AT reports the received signal strengths to the serving base station, which then directs the AT to update its active set in accordance with the reported strengths and one or more threshold conditions.

In order to support concurrent communication in multiple channels on a common frequency, each channel is allocated a fraction of the total forward-link power available in the sector. The power allocated to each channel is determined so as to optimize the signal-to-noise characteristics of all the channels, and may vary with time according to the number of access terminals being serviced, and their relative positions with respect to the BTS, among other factors. Similarly, on the reverse links, each access terminal transmits at a power level that optimizes the signal-to-noise while minimizing interference with other access terminals.

With arrangement described above, an access terminal can engage in cellular voice or packet-data communications. Referring again to FIG. 2, and taking an originating call from AT 202 as an example, AT 202 first sends an origination request over air interface 203 and via the BTS 204 and BSC 206 to MSC 208. The MSC then signals back to the BSC directing the BSC to assign an air interface traffic channel for use by the access terminal. For a voice call, the MSC uses well-known circuit protocols to signal call setup and establish a circuit connection to a destination switch that can then connect the call to a called device (e.g., landline phone or another access terminal). As discussed above, a voice call can include a call segment or leg terminated at one end by the AT 202 and at the other end by a vocoder in the MSC 208.

For a packet-data session, the BSC signals to the PDSN 316 by way of PCF 214. The PDSN 216 and access terminal 202 then negotiate to establish a data link layer connection, such as a point to point protocol (PPP) session. Further, the PDSN 216 sends a foreign agent advertisement that includes a challenge value to the access terminal, and the access terminal responds with a mobile-IP registration request (MIP RRQ), including a response to the challenge, which the PDSN forwards to HA 222. The HA then assigns an IP address for the access terminal to use, and the PDSN passes that IP address via the BSC to the access terminal.

2. HIGH RATE PACKET-DATA COMMUNICATIONS

Under IS-2000, the highest rate of packet-data communications theoretically available on a fundamental traffic channel of the forward link is 9.6 kbps, dependent in part on the power allocated to the forward-link traffic channel and the resultant signal-to-noise characteristics. In order to provide higher rate packet-data service to support higher bandwidth applications, the industry introduced a new "high rate packet data (HRPD) system," which is defined by industry standard IS-856.

IS-856 leverages the asymmetric characteristics of most IP traffic, in which the forward link typically carries a higher load than the reverse link. Under IS-856, each access terminal maintains and manages an active set as described above, but receives forward-link transmission from only one active sector at a time. In turn, each sector transmits to all its active ATs on a common forward link using time division multiplexing (TDM) in order to transmit to only one access terminal at a time, but at the full power of the sector. As a result of the full-power allocation by the sector, an access terminal operating under IS-856 can, in theory, receive packet-data at a rate of at least 38.4 kbps and up to 2.4 Mbps on its forward link.

The reverse link under IS-856 retains largely the traditional IS-2000 code division multiplexing (CDM) format, albeit with the addition of a "data rate control" (DRC) channel used to indicate the supportable data rate and best serving sector for the forward link. Multiple, active ATs in a common serving sector can transmit concurrently on their respective reverse links to the sector's BTS. Each reverse link comprises distinct code channels, thereby enabling the BTS to distinguish among each AT's transmissions. As with IS-2000, the IS-856 reverse link transmissions are frame-based. Unlike the IS-856 forward link which is allocated the full power of the serving sector (or other coverage area) to each AT on a TDM basis, the power applied to the reverse link from each of possibly multiple ATs in a common serving sector is individually controlled by the base station using the same methods described above for IS-2000.

TDM access on the IS-856 forward link is achieved by dividing the forward link in the time domain into time slots of length 2048 chips each. At a chip rate of 1.228 Mega-chips per second, each slot has a duration of 1.67 milliseconds (ms). Each time slot is further divided into two 1024-chip half-slots, each half-slot arranged to carry a 96-chip pilot "burst" (pilot channel) at its center and a Medium Access Control (MAC) channel in two 64-chip segments, one on each side of the pilot burst. The remaining 1600 chips of each time slot (800 per half-slot) are allocated for a forward traffic channel or a forward control channel, so that any given time slot will carry either traffic-channel data (if any exists) or control-channel data. Traffic-channel data comprise user application data, while control-channel data comprise IS-856 control messages. As in IS-2000, each sector in IS-856 is defined by a PN offset, and the pilot channel carries an indication of the sector's PN offset. Also as in IS-2000, an access terminal operating under IS-856 monitors the pilot signal emitted by various sectors in order to facilitate active set management, i.e., as a basis to facilitate handoff from one sector to another.

Operation in an IS-856 compliant communication system may be illustrated, again with reference to FIG. 2. To acquire packet data connectivity under IS-856, after an access terminal first detects an IS-856 carrier, the access terminal sends to its BSC (or RNC) 206 a UATI (Universal Access Terminal Identifier) request, and receives in response an UATI, which the access terminal can then use to identify itself in subsequent communications with the BSC. The access terminal then sends a connection-request to the BSC 206, and the BSC responsively invokes a process to authenticate the access terminal and to have the access terminal acquire a data link.

In particular, the BSC 206 sends an access request to an Access Network AAA (ANAAA) server (which may be different than the AAA server 220), and the ANAAA server authenticates the access terminal. The BSC 206 then assigns radio resources for the data session, providing a MAC identifier ("MAC ID") to the AT for identifying its time-slot data sent in the forward-link traffic channel, and a Walsh code for a sending data on the reverse-link traffic channel. Further, the BSC signals to the PDSN 216 (via PCF 214), and the PDSN and access terminal then negotiate to establish a PPP data link. In addition, as in the IS-2000 process, the access terminal then sends an MIP RRQ to the PDSN, which the PDSN forwards to the HA 222, and the HA assigns a mobile-IP address for the access terminal to use.

Once the access terminal has acquired an IS-856 radio link, a data link, and an IP address, the access terminal is considered to be in an active mode. In active mode, the AT receives its data distributed across MAC-identified time slots transmitted by the BTS using the full power of the forward link of the sector selected by the AT (as described above). Thus, the access terminal recognizes its time-slot data from among other time slots by a MAC identifier included in each transmission, and processes only those time slots with the AT's assigned MAC identifier. Using the full power of the forward link maximizes the signal-to-noise ratio, thus facilitating higher rate data communication than the power-limited conventional CDMA channels.

3. CONTROL OF DISCONTINUOUS TRANSMISSION BASED ON VOCODER AND VOICE ACTIVITY a. Operating Principles

As described above, a voice call in a wireless network typically includes a call leg terminated at one end by an access terminal and at the other end by a vocoder in an MSC (or other network switch. Such a call leg may also include an air link between the AT and a base station (e.g., BTS and BSC), as well as a connection between the BSC and the MSC. FIG. 2 illustrates an example of combined links between an AT 202 and an MSC 208. The voice call may ultimately terminate at another client device, such as another AT or a landline phone, for example. The description below focuses primarily on the call leg between the AT and the vocoder, however.

A typical voice conversation carried in a voice call may include time intervals when there is no voice or audio input to an AT (or other client device). For example, a user of the AT may not be speaking at any given moment. In a continuous transmission call, transmission from the AT on its reverse link could continue even when during these time intervals in which voice input is absent. In this case, some form of audio noise may be encoded and transmitted from the AT on a continuous basis. The transmitted audio noise is received and decoded by the vocoder, and ultimately transmitted a client device at the other end of the voice call. The receiving client device may then output the noise, essentially as transmitted. Such noise may be perceived as "natural" in sound to a user at the receiving client device. From the perspective of bandwidth usage, however, transmitting silence or noise may be inefficient and/or wasteful.

In order to conserve bandwidth on the call leg, particularly on the air-link portion, discontinuous transmission may be used to avoid allocation of transmission resources during time intervals in which there is no audio input at the access terminal. More particularly, an AT may be able to distinguish voice activity from silence or background noise. For example, a vocoder in the AT may have such a capability. During time intervals of a voice call when the AT detects voice activity, it may encode the voice (or audio) input for transmission in continuous, sequential frames. However, when the AT determines an absence of voice activity (or other indication of silence, for example), the AT may then cease encoding input. Since there will be no data to transmit during such silence intervals, the AT may cease transmitting frames on its reverse link. Consequently, the reverse link capacity otherwise consumed by frame transmissions will be conserved, and possibly made available for other devices, users, or applications. The interruption of continuously transmitted frames is thus referred to as discontinuous transmission, or DTX.

A complete absence of transmissions by the AT could result in "pure" silence at the receiving end of the voice call. However, such pure silence can sometimes lead to unintended and/or undesirable effects. For example, a user hearing pure silence may mistake it for a dropped call, and hang up or disconnect in response. Even if not mistaken, pure silence can sound unnatural in the context of a conversation, or perhaps acoustically disconcerting. Consequently, instead of presenting pure silence to a receiving client during times of no audio input at a sending AT, the AT uses reduced bandwidth to transmit "silence information" to the MSC vocoder during silence intervals. The vocoder may use the silence information to synthetically generate noise, and transmit the generated "comfort" noise to the receiving client.

Under CDMA 2000 Spread Spectrum Systems Revision E, for example, an AT will send a continuous sequence of voice frames when it detects voice activity. When silence is detected at the AT input (i.e., user input), the AT may enter a silence mode in which it interrupts transmitting continuous voice frames, and instead transmits periodic silence frames, each containing a silence insertion descriptor, or SID, as described above. Each SID can include a parameterized description of noise. The vocoder in the MSC that receives the SID frames may use the SIDs to generate comfort noise.

Each voice frame can contain sampled voice data encoded by the vocoder at a maximum or full bit rate. By way of example, for 20 ms frames, full rate encoding corresponds to 9,600 bits per second. The vocoder may also be able to encode at one-half rate (4,800 bits per second), one-quarter rate (2,400 bits per second), and one-eighth rate (1,200 bits per second), where, again, these rates correspond to 20 ms frames. Bit rates may account for some "overhead" bits, in addition to encoded symbols representing sampled voice data. When transmitting SID frames, the vocoder may typically use one-eighth rate frames. In addition to transmitting SID frames only periodically, the reduced bit rate may thus effectively consume less transmission resources, since the lower bit rate may be accommodated by a lower transmission power.

During a silence interval when the AT is transmitting periodic SID frames, the frame period (interval between SID frames) is set to a value between DTXmin and DTXmax. Thus, the AT transmits a SID frame at least once in every DTXmax interval. The AT does not transmit any frames to the vocoder in between SID frames. Accordingly, the vocoder may detect the absence of frame transmissions in an inter-frame interval as a blank frame (or portion thereof); e.g., one that contains no detectable data.

While a vocoder may be capable of decoding SID frames and generating comfort noise based on the information contained in them, some vocoders may also respond to receiving at least a threshold number of blank frames by entering a mute state. For example, a vocoder may enter a mute state after receiving two consecutive blank frames. In this case, the threshold number would be two; other threshold numbers are possible as well. Consequently, an AT that transmits SID frames with frame period of two or more frames may cause the vocoder in the MSC to enter a mute state.

In a mute state, the vocoder ceases transmitting audio date to the AT. The absence of transmissions on the forward link to the AT may in turn cause the call to drop. Accordingly, dropping a call could be an unintended and/or undesirable effect of insufficiently frequent SID frames.

Figure 3:
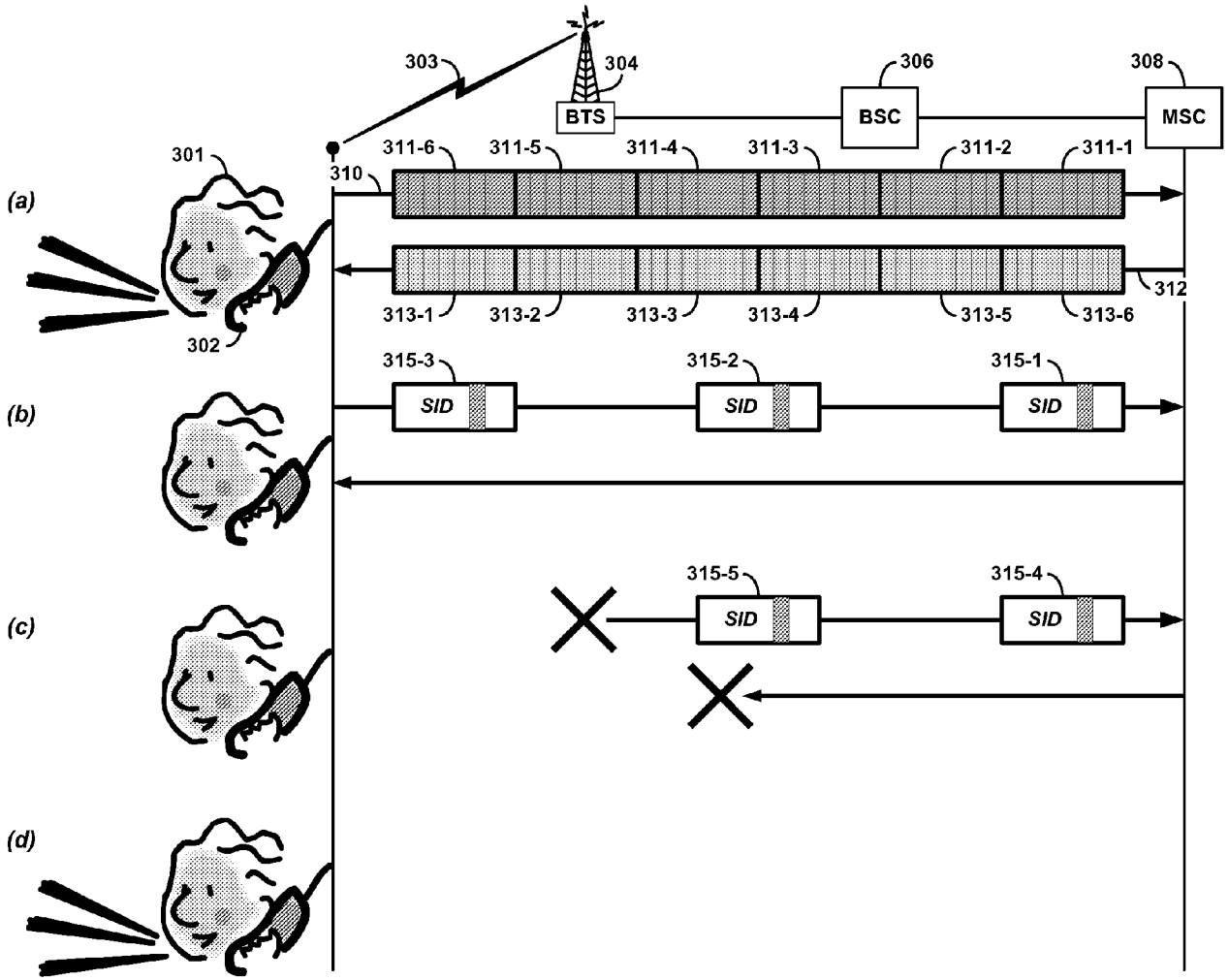
FIG. 3 illustrates an example of conventional operation of discontinuous transmission.

Conventional control of DTX transmission as described above is illustrated in FIG. 3. In the figure, a cartoon of a user 301 is depicted as engaging in a voice call on an AT 302. An air link 303 connects the AT 302 with a BTS 304, which is then connected to an MSC 308 by way of a BSC 306. Although not explicitly shown in the figure, the MSC 308 may be assumed to include a vocoder that terminates a call leg with the AT, as described above.

By way of example, four representative instances during the voice call are shown, labeled from top to bottom as "(a)," "(b)," "(c)," and "(d)." During instance (a), the user is depicted as speaking; during instances (b) and (c), the user is depicted as silent; and during instance (d), the user is depicted as again speaking. It will be appreciated that the term "instance" as used in the present discussion is meant to refer to a time interval, and not necessarily to a precise instant in time having no duration. Note that the numeric labels for the user 301 and the AT 302 are only shown for instance (a); they should be understood to apply in a link manner to the cartoon user and AT displayed in the other three instances as well.

During instance (a), a reverse link 310 supports continuous transmission of voice frames 311-1, 311-2, 311-3, 311-4, 311-5, and 311-6 from the AT 302 to the MSC 308. Each of the voice frames is shown as containing eight "blocks," meant to represent encoded data. In this illustration, the eight blocks in a given frame are not intended to have a precise correspondence to an actual data format, but rather to conceptually represent a full-rate frame. That is, each frame is fully occupied. Also during instance (a), a forward link 312 supports continuous transmission of frames 313-1, 313-2, 313-3, 313-4, 313-5, and 313-6 from the MSC 308 to the AT 302. As with the reverse link, and also by way of example, each of the reverse-link frames is represented as a full-rate frame.

Instance (b) corresponds to a silence interval. As shown, the AT 302 transmits only periodic SID frames 315-1, 315-2, and 315-3 on the reverse link 310 (the label "310" has been omitted for the sake of brevity in the figure). Each of the SID frames is shown as containing just one block, meant, in this example, to conceptually represent a one-eighth rate frame. Evidently, and by way of example, the inter-frame interval is at least as long as the threshold number of blank frames that causes the vocoder in the MSC 308 to enter a mute state. This is illustrated by the absence of any frames transmitted from the MSC 308 to the AT 302 on the forward link 312 (again, the label "312" has been omitted for the sake of brevity in the figure).

Instance (c) corresponds to a continuation of the silence interval shown during instance (b). Two additional SID frames 315-4 and 315-5 are shown on the reverse link 310 for illustrative purposes. However, the persistence of the mute state, and the corresponding absence of transmission from the MSC 308 to the AT 302, has evidently (and by way of example) caused the call to drop. The dropping of the call is depicted conceptually by the large "X" that interrupts each of the reverse link 310 and the forward link 312 during instance (c).

During instance (d), the user 301 evidently (and by way of example) begins speaking again. However, the call was dropped (in this example) during the silence interval of instance (c). The resumption of speaking by the user 301 is meant to signify that the dropping of the call was unexpected and/or unintended. Accordingly, the reception of the threshold number of blank frames by the MSC 308 during the silence interval that began during instance (b) has evidently resulted in this undesirable consequence.

To help avoid causing a vocoder to enter a mute state due to reception of the threshold number of blank frames, DTXmin and DTXmax may be set to keep the inter frame interval relatively short. However, an AT may communicate with different vocoders at different times, and may therefore encounter vocoders with different threshold values for the number of blank frames that cause transition to a mute state. It would therefore be advantageous for an access terminal to be able to recognize and/or determine when a vocoder has entered (or is likely to enter) mute as a result of the AT's inter-frame interval for SID frames being at least as big as the vocoder's threshold number for blank frames.

In accordance with example embodiments, an access terminal may employ monitoring of incoming voice activity from a vocoder, together with recognition that the access terminal is operating during a silence interval, to determine that the vocoder has entered (or is likely to enter) a mute state. The AT may then take action to prevent or discourage the vocoder from entering the mute state, or cause the vocoder to exit the mute state. By so doing, the AT may avert a dropped call that might otherwise be caused by persistence of mute-state operation by the vocoder. An example embodiment of control of discontinuous transmission based on vocoder and voice activity is illustrated in terms of example operation in the next subsection.

b. Example Operation

Figure 4:
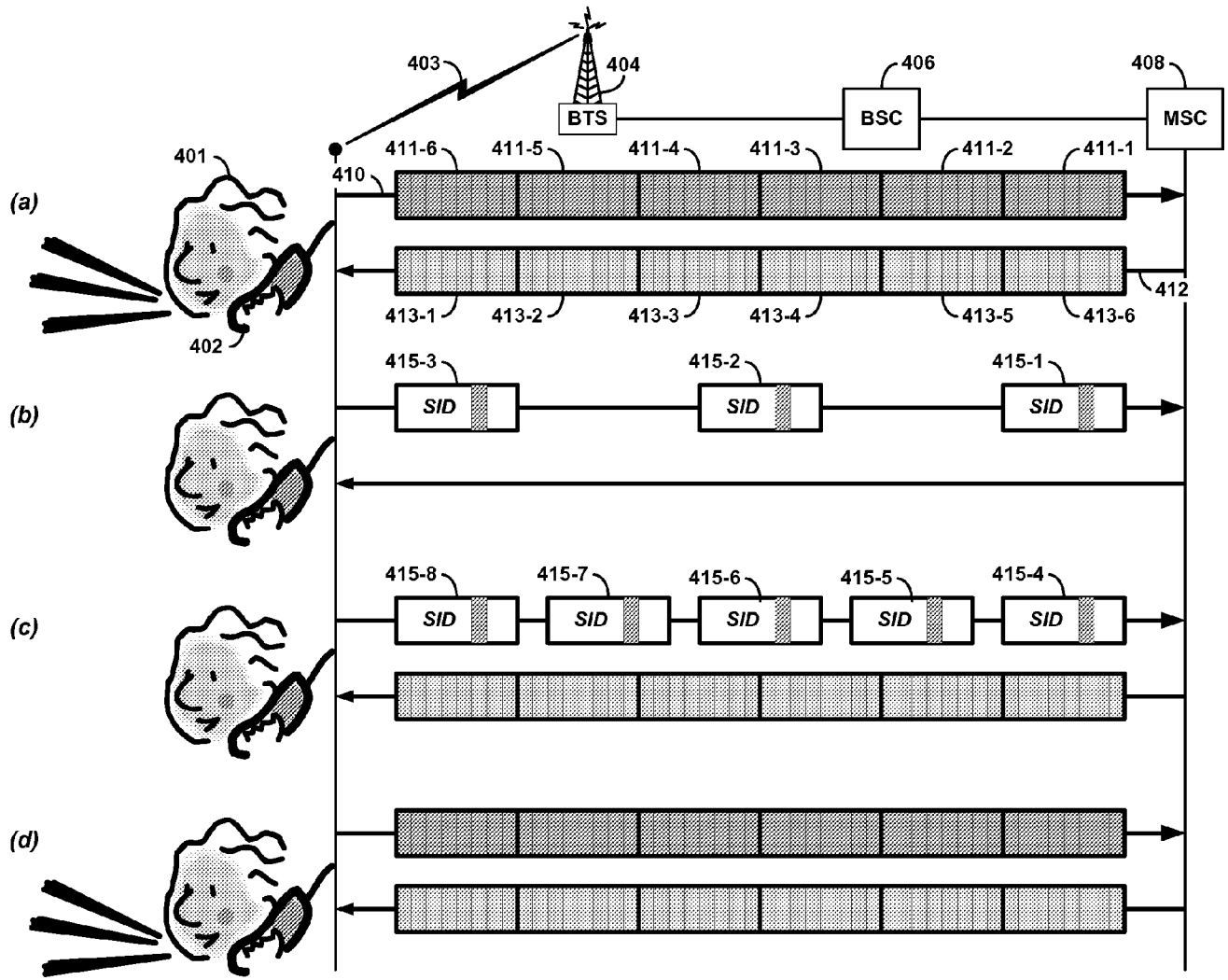
FIG. 4 illustrates an example of operation of control of discontinuous transmission based on vocoder and voice activity.

FIG. 4 illustrates the operating principles of an example embodiment control of discontinuous transmission based on vocoder and voice activity. The format and the meaning of the symbols shown in FIG. 4 are the same as those used in FIG. 3; the numeric labels are also the same as those in FIG. 3, except that the label numbers begin with "4" instead of "3."

Again by way of example, FIG. 4 depicts the same four instances of a call leg between the AT 402 (and the user 401) and a vocoder in the MSC 408. The call leg is carried via the BTS 404 and the BSC 406, and connections therebetween. The explanation of instances (a) and (b) of FIG. 3 may be applied as well to instances (a) and (b) of FIG. 4. Namely, during instance (a), voice frames 411-1, 411-2, 411-3, 411-4, 411-5, and 411-6 are transmitted on the reverse link 410 from the AT 402 to the MSC 408, and frames 413-1, 413-2, 413-3, 413-4, 413-5, and 413-6 are transmitted on the forward link 412 from the MSC 408 to the AT 402. During instance (b), the AT 402 transmits only periodic SID frames 415-1, 415-2, and 415-3 on the reverse link 410. The absence of any frames transmitted from the MSC 408 to the AT 402 on the forward link 412 during instance (b) can again be taken to be a consequence of the inter-frame interval being at least as long as the threshold number of blank frames that causes the vocoder in the MSC 408 to enter a mute state.

In accordance with the example embodiment, the AT 402 may determine that incoming voice activity from the vocoder has dropped below a threshold level (possibly having ceased entirely) during a time when the AT is operating in a silence mode, and thus only transmitting periodic SID frames to the vocoder. Although not explicitly shown in FIG. 4, the AT 402 may make this determination during instance (b), where as illustrated, no frames are received on the forward link from the vocoder (in the MSC 408).

More specifically, the AT 402 may monitor incoming voice activity by measuring a voice activity factor (or VAF) from the vocoder. For example, VAF can be measured as a number of voice (or audio) frames per unit time received form MSC 408. Typically, VAF may be measured in frames per second, although other time units may be used, as well as other forms of metrics for VAF. If the AT 402 determines the incoming VAF is below a threshold VAF level while the AT is in a silence interval of a voice call via the vocoder (in the MSC 408), the AT may accordingly infer that the vocoder has entered (or is likely to enter) a mute state in response to inter-frame intervals of SID frames from the AT longer than the vocoder's threshold for blank frames.

In further accordance with the example embodiment, the AT may store one or more threshold VAF values in some form of memory, such as flash, solid state, or the like. The AT could then compare the measured VAF with one of the stored values in order to determine if the incoming VAF is below the threshold. Different threshold VAF values might be applied to different MSCs (and/or vocoders), for example.

In response to determining that the vocoder has entered (or is likely to enter) a mute state in response to inter-frame intervals of SID frames from the AT longer than the vocoder's threshold for blank frames, the AT could then adjust one or both of DTXmax and DTXmin in order cause an increase rate of SID frame transmission, and correspondingly, a shorter inter-frame interval. By doing so, the AT may cause the vocoder to exit the mute state (or avert entry into the mute state), and begin (or maintain) transmissions on the forward link to the AT. As a result, dropping the call might be averted.

The related operation is depicted as occurring during instance (c) in FIG. 4. Specifically, the AT 402 is shown as transmitting SID frames 415-4, 415-5, 415-6, 415-7, and 415-8 on the reverse link 410. As represented in the figure, the inter-frame intervals between these SID frames is smaller than between the SID frames transmitted during instance (b). The smaller inter-frame intervals are taken, by way of example, to be shorter than the vocoder's threshold number of blank frames. The result, as illustrated in instance (c), is that the vocoder in the MSC 408 exits (or never enters) the mute state, and thus continues to transmit frames on the forward link. Consequently, the call is not dropped, as illustrated during instance (d), where the user 401 begins speaking again. As shown, the reverse and forward links carry voice frames, as they did during instance (a).

In accordance with the example embodiment, the AT could adjust the range defined by DTXmax and DTXmin so as to shorten the inter-frame interval sufficient and thereby cause an immediate SID frame transmission. Defining the SID frame period (i.e., the inter-frame interval) as PSID, the relation between DTXmax, DTXmin, and PSID may be expressed in inequality DTXmax≥PSID≥DTXmin. Thus, the AT could shorten the SID frame period either by reducing DTXmax and/or adjusting both DTXmax and DTXmin to move the entire range to smaller values. Specifically, if the current value of DTXmax is strictly greater than that of DTXmin, the AT could reduce DTXmax down to new value no smaller than DTXmin. If instead, the current value of DTXmax is equal to that of DTXmin, the AT could reduce both DTXmax and DTXmin, possibly making DTXmin smaller than DTXmax. In either case, PSID will tend to decrease. The AT could make the adjustment until a SID frame is transmitted.

In further accordance with the example embodiment, the AT may store PSID, DTXmax, and DTXmin as parameter values in some form of memory, such as flash, solid state, or the like. The AT could carry out adjustments described above by reading and possibly modifying the memory content corresponding to the stored parameters.

As an alternative or additional aspect of the example embodiment, the vocoder (or the MSC 408) could inform the AT 402 when it enter a mute state (or is about or likely to do so) in response to having received a threshold number of blank frames from the AT 402. For example, the vocoder (or MSC) could transmit a message to the AT indicating that is has or will enter a mute state. The AT 402 could respond by making the adjustments to DTXmax and/or DTXmin described above. Implementation of this alternative or additional aspect could be done by adding the corresponding capabilities to the vocoder (or MSC).

4. IMPLEMENTATION OF EXAMPLE EMBODIMENTS

The example embodiment of control of discontinuous transmission based on vocoder and voice activity described above can be implemented as a method in an access terminal configured to operate in a wireless communication system, such as the one described above in connection with FIG. 2. The method could also include functions carried out by an MSC that is part of the wireless communication system. In view of a possible role of the MSC in the example method, the example method may be considered as having an AT-side aspect, carried out in the AT, and a network-side aspect, carried out in an MSC (or other network switch). The discussion above of FIG. 1 provides an example of such a method. The next subsections illustrate an example access terminal and an example MSC an example methods could be implemented.

a. Example Access Terminal

Figure 5:
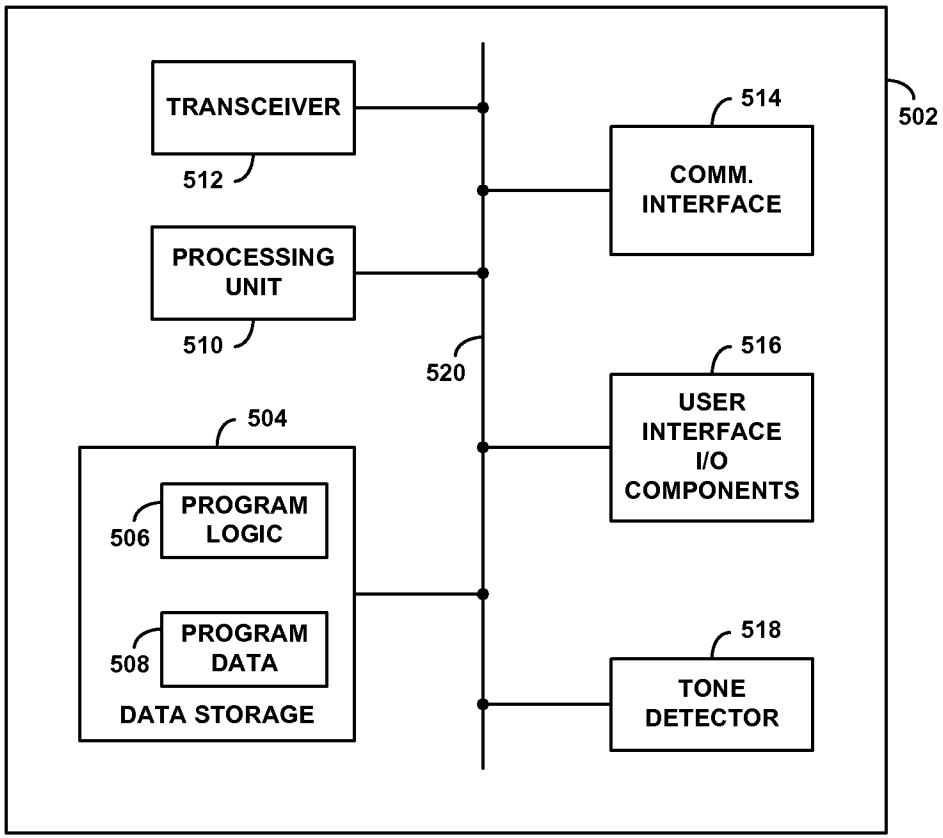
FIG. 5 is a block diagram of an example access terminal in which control of discontinuous transmission based on vocoder and voice activity could be implemented.

FIG. 5 is a simplified block diagram depicting functional components of an example access terminal 502 in which an example embodiment of an AT-side aspect of control of discontinuous transmission based on vocoder and voice activity, for example, to the example method described in FIG. 1 above. The example AT 502 could be a cell phone, a personal digital assistant (PDA), a pager, a wired or wirelessly-equipped notebook computer, or any other sort of device. As shown in FIG. 5, the example AT 502 includes data storage 504, processing unit 510, transceiver 512, communication interface 514, user-interface I/O components 516, and tone detector 518, all of which may be coupled together by a system bus 520 or other mechanism.

These components may be arranged to support conventional operation in a wireless communication network that is compliant with a CDMA family of protocols, such as network 200 illustrated in FIG. 2. The details of such an arrangement and how these components function to provide conventional operation are well-known in the art, and are not described further herein. Certain aspects of AT 502 relevant to adaptive rate control based on battery life are discussed briefly below.

Communication interface 514 in combination with transceiver 512, which may include one or more antennas, enables communication with the network, transmission of voice (or audio) frames and silence (e.g., SID) frames to the network, and reception of voice (or audio) frames and control messages from the network. The communication interface may include a module, such as an MSM™-series chipset made by Qualcomm Inc. of San Diego, Calif., and supports wireless packet-data communications according to a CDMA family of protocols.

Processing unit 510 comprises one or more general-purpose processors (e.g., INTEL microprocessors) and/or one or more special-purpose processors (e.g., dedicated digital signal processor, vocoder, application specific integrated circuit, etc.). In turn, the data storage 504 comprises one or more volatile and/or non-volatile storage components, such as magnetic or optical memory or disk storage. Data storage 504 can be integrated in whole or in part with processing unit 510, as cache memory or registers for instance. In example AT 502, as shown, data storage 504 is configured to hold both program logic 506 and program data 508.

Program logic 506 may comprise machine language instructions that define routines executable by processing unit 510 to carry out various functions described herein. In particular the program logic, communication interface, and transceiver may operate cooperatively to carry out logical operation, such as generating voice (or audio) frames and silence (e.g., SID) frames for transmission to the network, and other functions discussed above.

It will be appreciated that there can be numerous specific implementations of an access terminal, such as AT 502, in which an AT-side aspect of control of discontinuous transmission based on vocoder and voice activity could be implemented. Further, one of skill in the art would understand how to devise and build such an implementation. As such, AT 502 is representative of means for carrying out an AT-side aspect of control of discontinuous transmission based on vocoder and voice activity, in accordance with the methods and steps described herein by way of example.

b. Example MSC

Figure 6:
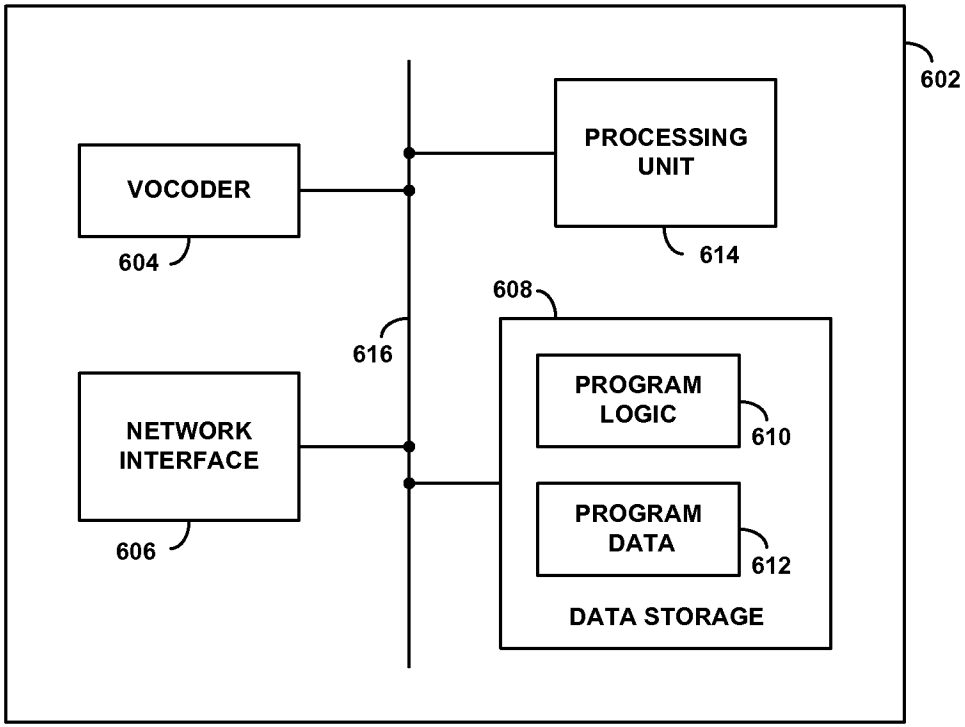
FIG. 6 is a block diagram of an example MSC in which control of discontinuous transmission based on vocoder and voice activity could be implemented.

FIG. 6 is a simplified block diagram depicting functional components of an example MSC (or network switch) 602 in which an example embodiment of a network-side aspect of control of discontinuous transmission based on vocoder and voice activity, for example, to the example method described in FIG. 1 above. As shown in FIG. 6, the example MSC 602, representative of MSC 208 in FIG. 2, for instance, includes a vocoder 604, network interface 606, a processing unit 614, and data storage 608, all of which may be coupled together by a system bus 616 or other mechanism. In addition, the MSC may also include external storage, such as magnetic or optical disk storage, although this is not shown in FIG. 6.

These components may be arranged to support conventional operation in a wireless communication network that is compliant with a CDMA family of protocols, such as network 200 illustrated in FIG. 2. The details of such an arrangement and how these components function to provide conventional operation are well-known in the art, and are not described further herein.

Network interface 606 enables communication on a network, such network 200. As such, network interface 606 may take the form of trunk or optical link that can be coupled with a base station, such as BSC 206, and/or with one or more other a TDM switches (e.g., other MSCs or trunk switches). The network interface 606 could also take the form of an Ethernet network interface card or other physical connection, among other possibilities. Further, network interface 606 in combination with vocoder 604 enables communication links with one or more access terminals via intervening base stations and air interface connections, supporting methods of control of discontinuous transmission based on vocoder and voice activity described herein.

Processing unit 614 comprises one or more general-purpose processors (e.g., INTEL microprocessors) and/or one or more special-purpose processors (e.g., dedicated digital signal processor, application specific integrated circuit, etc.). In turn, the data storage 608 comprises one or more volatile and/or non-volatile storage components, such as magnetic or optical memory or disk storage. Data storage 608 can be integrated in whole or in part with processing unit 614, as cache memory or registers for instance. As further shown, data storage 608 is equipped to hold program logic 610 and program data 612.

Program logic 610 may comprise machine language instructions that define routines executable by processing unit 614 to carry out various functions described herein. In particular the program logic, communication interface, and vocoder may operate cooperatively to carry out logical operation such as that discussed above. Further, program data 612 may be arranged to store data used in conjunction with the logical operations described above.

It will be appreciated that there can be numerous specific implementations of a network switch, such as MSC 602, in which a network-side aspect of control of discontinuous transmission based on vocoder and voice activity could be implemented. Further, one of skill in the art would understand how to devise and build such an implementation. As such, MSC 602 is representative of means for carrying out a network-side aspect of control of discontinuous transmission based on vocoder and voice activity, in accordance with the functions and steps described herein by way of example.

5. Conclusion

An exemplary embodiment of the present invention has been described above. Those skilled in the art will understand, however, that changes and modifications may be made to this embodiment without departing from the true scope and spirit of the invention, which is defined by the claims.

We claim:

1. In an access terminal (AT) configured to engage in communication sessions via a wireless communication network, a method comprising:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, the silence frames containing parameters for generation of audio noise by the network device;

making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the silence-frame rate is variable within a range between a minimum rate and a maximum rate, the minimum rate being no greater than the maximum rate, and wherein increasing the silence-frame rate comprises:

if the minimum rate is less than the maximum rate, increasing the minimum rate up to at most the maximum rate; and if the minimum rate equals the maximum rate, increasing both the minimum rate and the maximum rate, while keeping the minimum rate no greater than the maximum rate.

2. The method of claim 1, wherein the communication session is an audio communication session carried out via the network device, and wherein ceasing transmissions to the wireless communication network, except for transmitting silence frames at the silence-frame rate comprises:

interrupting continuous transmission of sequential frames of audio data of the audio communication session; and during the interruption, transmitting the silence frames interspersed with inter-frame intervals of no transmission, each of the inter-frame intervals lasting no longer than the arithmetic inverse of the silence-frame rate.

3. The method of claim 1, wherein making the determination comprises:

determining that the AT is operating during a silence interval and transmitting silence frames at the silence-frame rate; and while operating during the silence interval, determining that a receive rate of receiving audio transmissions from the network device is below a threshold receive rate.

4. The method of claim 1, wherein making the determination comprises:

determining that the AT is operating during a silence interval and transmitting silence frames at the silence-frame rate; and while operating during the silence interval, receiving a message from the network device indicating that the encoder-decoder has ceased transmitting audio data to the AT.

5. The method of claim 1, wherein increasing the silence-frame rate so as to reduce the duration of the absence of transmissions from the AT to be shorter than the threshold time interval, and correspondingly cause the encoder-decoder to begin transmitting audio data to the AT comprises increasing the silence-frame rate by an amount that results in an immediate transmission of a silence frame to the network device.

6. In an access terminal (AT) configured to engage in communication sessions via a wireless communication network, a method comprising:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, the silence frames containing parameters for generation of audio noise by the network device;

making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the AT is further configured to operate according a CDMA family of protocols, including CDMA 2000 Spread Spectrum Systems Revision E, wherein the network device is a network switch, and the encoder-decoder is a vocoder, wherein the communication session is voice communication session carried out via the vocoder in the network switch according to a discontinuous transmission (DTX) protocol, wherein transmitting silence frames at the silence-frame rate comprises transmitting silence frames interspersed with inter-frame intervals of no transmission, each of the inter-frame intervals having a duration in a range between a DTX minimum and a DTX maximum, DTX maximum being no smaller than DTX minimum, wherein the parameters for generation of audio noise by the network device comprise silence insertion descriptors (SIDs), wherein making the determination comprises determining that the vocoder has entered a mute state of operation, and wherein increasing the silence-frame rate so as to reduce the duration of the absence of transmissions from the AT comprises:

if DTX maximum is greater than DTX minimum, decreasing DTX maximum to no smaller than DTX minimum; and if DTX maximum equals DTX minimum, decreasing both DTX maximum and DTX minimum, while keeping DTX maximum no smaller than DTX minimum.

7. The method of claim 6, wherein determining that the vocoder has entered a mute state of operation comprises:

while operating during the silence interval, determining that a voice activity factor (VAF) of voice frames received from the network switch is below a threshold VAF.

8. The method of claim 6, wherein determining that the vocoder has entered a mute state of operation comprises:

while operating during the silence interval, receiving a message from the network switch indicating that the vocoder has entered the mute state of operation.

9. An access terminal (AT) configured to engage in communication sessions via a wireless communication network, the AT comprising:

one or more processors;

memory accessible by the one or more processors; and computer-readable instructions stored in the memory that upon execution by the one or more processors cause the AT to carry out functions including:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device, making a determination that in response to an absence of transmissions from the AT for a duration at least as long as a threshold time interval, the encoder-decoder has ceased transmitting audio data to the AT, and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the silence-frame rate is variable within a range between a minimum rate and a maximum rate, wherein the minimum rate is no greater than the maximum rate, and wherein increasing the silence-frame rate comprises:

if the minimum rate is less than the maximum rate, increasing the minimum rate up to at most the maximum rate; and if the minimum rate equals the maximum rate, increasing both the minimum rate and the maximum rate, while keeping the minimum rate no greater than the maximum rate.

10. The AT of claim 9, wherein ceasing transmissions to the wireless communication network, except for transmitting silence frames at the silence-frame rate comprises:

interrupting continuous transmission of sequential frames of audio data of the communication session being engaged in by the AT via the network device; and during the interruption, transmitting the silence frames interspersed with inter-frame intervals of no transmission, wherein each of the inter-frame intervals lasts no longer than the arithmetic inverse of the silence-frame rate.

11. The AT of claim 9, wherein making the determination comprises:

determining that the AT is operating during a silence interval and transmitting silence frames at the silence-frame rate; and while operating during the silence interval, determining that a receive rate of receiving audio transmissions from the network device is below a threshold receive rate.

12. The AT of claim 9, wherein making the determination comprises:

determining that the AT is operating during a silence interval and transmitting silence frames at the silence-frame rate; and while operating during the silence interval, receiving a message from the network device indicating that the encoder-decoder has ceased transmitting audio data to the AT.

13. The AT of claim 9, wherein increasing the silence-frame rate so as to reduce the duration of the absence of transmissions from the AT to be shorter than the threshold time interval, and correspondingly cause the encoder-decoder to begin transmitting audio data to the AT comprises increasing the silence-frame rate by an amount that will result in an immediate transmission of a silence frame to the network device.

14. An access terminal (AT) configured to engage in communication sessions via a wireless communication network, the AT comprising:

one or more processors;

memory accessible by the one or more processors; and computer-readable instructions stored in the memory that upon execution by the one or more processors cause the AT to carry out functions including:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device, making a determination that in response to an absence of transmissions from the AT for a duration at least as long as a threshold time interval, the encoder-decoder has ceased transmitting audio data to the AT, and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the AT is further configured to operate according a CDMA family of protocols, including CDMA 2000 Spread Spectrum Systems Revision E, wherein the network device is a network switch, and the encoder-decoder is a vocoder, wherein the communication session is voice communication session carried out via the vocoder in the network switch according to a discontinuous transmission (DTX) protocol, wherein transmitting silence frames at the silence-frame rate comprises transmitting silence frames interspersed with inter-frame intervals of no transmission, wherein each of the inter-frame intervals has a duration in a range between a DTX minimum and a DTX maximum, and DTX maximum is no smaller than DTX minimum, wherein the parameters for generation of audio noise by the network device comprise silence insertion descriptors (SIDs), wherein making the determination comprises determining that the vocoder has entered a mute state of operation, and wherein increasing the silence-frame rate so as to reduce the duration of the absence of transmissions from the AT comprises:

if DTX maximum is greater than DTX minimum, decreasing DTX maximum to no smaller than DTX minimum; and if DTX maximum equals DTX minimum, decreasing both DTX maximum and DTX minimum, while keeping DTX maximum no smaller than DTX minimum.

15. The AT of claim 14, wherein determining that the vocoder has entered a mute state of operation comprises:

while operating during the silence interval, determining that a voice activity factor (VAF) of voice frames received from the network switch is below a threshold VAF.

16. The AT of claim 14, wherein determining that the vocoder has entered a mute state of operation comprises:

while operating during the silence interval, receiving a message from the network switch indicating that the vocoder has entered the mute state of operation.

17. A non-transient computer-readable medium having instructions stored thereon that, upon execution by one or more processors of an access terminal (AT) configured to engage in communication sessions via a wireless communication network, cause the AT to carry out functions including:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device;

making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the silence-frame rate is variable within a range between a minimum rate and a maximum rate, wherein the minimum rate is no greater than the maximum rate, and wherein increasing the silence-frame rate comprises:

if the minimum rate is less than the maximum rate, increasing the minimum rate up to at most the maximum rate; and if the minimum rate equals the maximum rate, increasing both the minimum rate and the maximum rate, while keeping the minimum rate no greater than the maximum rate.

18. The non-transient computer-readable medium of claim 17, wherein the communication session is an audio communication session carried out via the network device, and wherein ceasing transmissions to the wireless communication network, except for transmitting silence frames at the silence-frame rate comprises:

interrupting continuous transmission of sequential frames of audio data of the audio communication session; and during the interruption, transmitting the silence frames interspersed with inter-frame intervals of no transmission, wherein each of the inter-frame intervals lasts no longer than the arithmetic inverse of the silence-frame rate.

19. The non-transient computer-readable medium of claim 17, wherein making the determination comprises:

determining that the AT is operating during a silence interval and transmitting silence frames at the silence-frame rate; and while operating during the silence interval, determining that a receive rate of receiving audio transmissions from the network device is below a threshold receive rate.

20. The non-transient computer-readable medium of claim 17, wherein making the determination comprises:

determining that the AT is operating during a silence interval and transmitting silence frames at the silence-frame rate; and while operating during the silence interval, receiving a message from the network device indicating that the encoder-decoder has ceased transmitting audio data to the AT.

21. The non-transient computer-readable medium of claim 17, wherein increasing the silence-frame rate so as to reduce the duration of the absence of transmissions from the AT to be shorter than the threshold time interval, and correspondingly cause the encoder-decoder to begin transmitting audio data to the AT comprises increasing the silence-frame rate by an amount that will result in an immediate transmission of a silence frame to the network device.

22. A non-transient computer-readable medium having instructions stored thereon that, upon execution by one or more processors of an access terminal (AT) configured to engage in communication sessions via a wireless communication network, cause the AT to carry out functions including:

during silence intervals of a communication session in which the AT has determined it has no audio data to transmit, ceasing transmissions to the wireless communication network, except for transmitting silence frames at a silence-frame rate to an encoder-decoder in a network device in the wireless communication network, wherein the silence frames contain parameters for generation of audio noise by the network device;

making a determination that in response to an absence of transmissions from the AT for a duration at least as long as a threshold time interval, the encoder-decoder has ceased transmitting audio data to the AT; and in response to making the determination, increasing the silence-frame rate so as to reduce the duration of the absence of transmissions from the AT to be shorter than the threshold time interval, and correspondingly cause the encoder-decoder to begin transmitting audio data to the AT, wherein the AT is further configured to operate according a CDMA family of protocols, including CDMA 2000 Spread Spectrum Systems Revision E, wherein the network device is a network switch, and the encoder-decoder is a vocoder, wherein the communication session is voice communication session carried out via the vocoder in the network switch according to a discontinuous transmission (DTX) protocol, wherein transmitting silence frames at the silence-frame rate comprises transmitting silence frames interspersed with inter-frame intervals of no transmission, wherein each of the inter-frame intervals has a duration in a range between a DTX minimum and a DTX maximum, and DTX maximum is no smaller than DTX minimum, wherein the parameters for generation of audio noise by the network device comprise silence insertion descriptors (SIDs), wherein making the determination comprises determining that the vocoder has entered a mute state of operation, and wherein increasing the silence-frame rate so as to reduce the duration of the absence of transmissions from the AT comprises:

if DTX maximum is greater than DTX minimum, decreasing DTX maximum to no smaller than DTX minimum; and if DTX maximum equals DTX minimum, decreasing both DTX maximum and DTX minimum, while keeping DTX maximum no smaller than DTX minimum.

23. The non-transient computer-readable medium of claim 22, wherein determining that the vocoder has entered a mute state of operation comprises:

while operating during the silence interval, determining that a voice activity factor (VAF) of voice frames received from the network switch is below a threshold VAF.

24. The non-transient computer-readable medium of claim 22, wherein determining that the vocoder has entered a mute state of operation comprises:

while operating during the silence interval, receiving a message from the network switch indicating that the vocoder has entered the mute state of operation.

* * * * *